US005834735A

United States Patent [19]

Flowers

[11] Patent Number: 5,834,735

[45] Date of Patent: Nov. 10, 1998

[54] DEVICE FOR FORMING POINTS ON HAIR BRAIDS

[76] Inventor: Hermeoine Flowers, 414 Jackson - Pecan Grove, Allendale, S.C. 29810

[21] Appl. No.: 675,283

[22] Filed: Jul. 1, 1996

[51] Int. Cl.[6] ..... A45D 26/00

[52] U.S. Cl. ..... 219/223; 219/222; 219/227; 126/224

[58] Field of Search ..... 219/221, 222, 219/225, 227; 132/224, 225; 126/226, 229–234

[56] References Cited

U.S. PATENT DOCUMENTS

| | | | |
|---|---|---|---|
| 2,114,703 | 4/1938 | Conner | 219/221 |
| 3,029,330 | 4/1962 | Ohnstad | 219/227 |
| 4,103,145 | 7/1978 | Oliveri | 219/222 |
| 4,166,472 | 9/1979 | Battaglia | 132/224 |
| 5,091,629 | 2/1992 | McGee | 219/222 |

FOREIGN PATENT DOCUMENTS

| | | | |
|---|---|---|---|
| 839396 | 5/1952 | Germany | 219/535 |

*Primary Examiner*—Teresa J. Walberg
*Assistant Examiner*—Quan Nguyen
*Attorney, Agent, or Firm*—B. Craig Killough

[57] ABSTRACT

A device which will form a point at the end of a hair braid having a heating element with a v-shaped or a conically shaped void in the heating element. A hair braid is inserted into the void, and held until the hair is burned by the heating element to form a point in the end of the braid.

11 Claims, 3 Drawing Sheets

DEVICE FOR FORMING POINTS ON HAIR BRAIDS

FIELD OF THE INVENTION

This invention relates to hair styling devices.

BACKGROUND OF THE INVENTION

It is popular to braid hair. Hair braids are most popular for women in our society, however, both men and women form braids from their hair.

Braids are formed by twisting strands of hair together in an organized fashion. While the braids themselves are formed in a consistent and neat manner, the ends of the braids have a frayed look unless the ends of the braids are shaped. One way to shape the ends of hair braids is by burning the ends of the braids. In the prior art, braids are shaped by burning the ends over an open flame. The use of an open flame is a safety hazard, and further, the use of an open flame alone does not produce a braid with a styled shape. It is preferred by many persons to form a point at the end of the braid. The preferred point is a conical v-shape which is formed at the end of the braid.

SUMMARY OF THE PRESENT INVENTION

The present invention is a device which will form a point at the end of a hair braid. A heating element is provided. The heating element has a v-shaped or a conically shaped void in the heating element. The hair braid is inserted into the void, and held until the hair is burned by the heating element to form a point in the end of the braid.

DETAILED DESCRIPTION OF THE DRAWINGS

DETAILED DESCRIPTION OF THE PREFERRED EMBODIMENT

Figure 1:
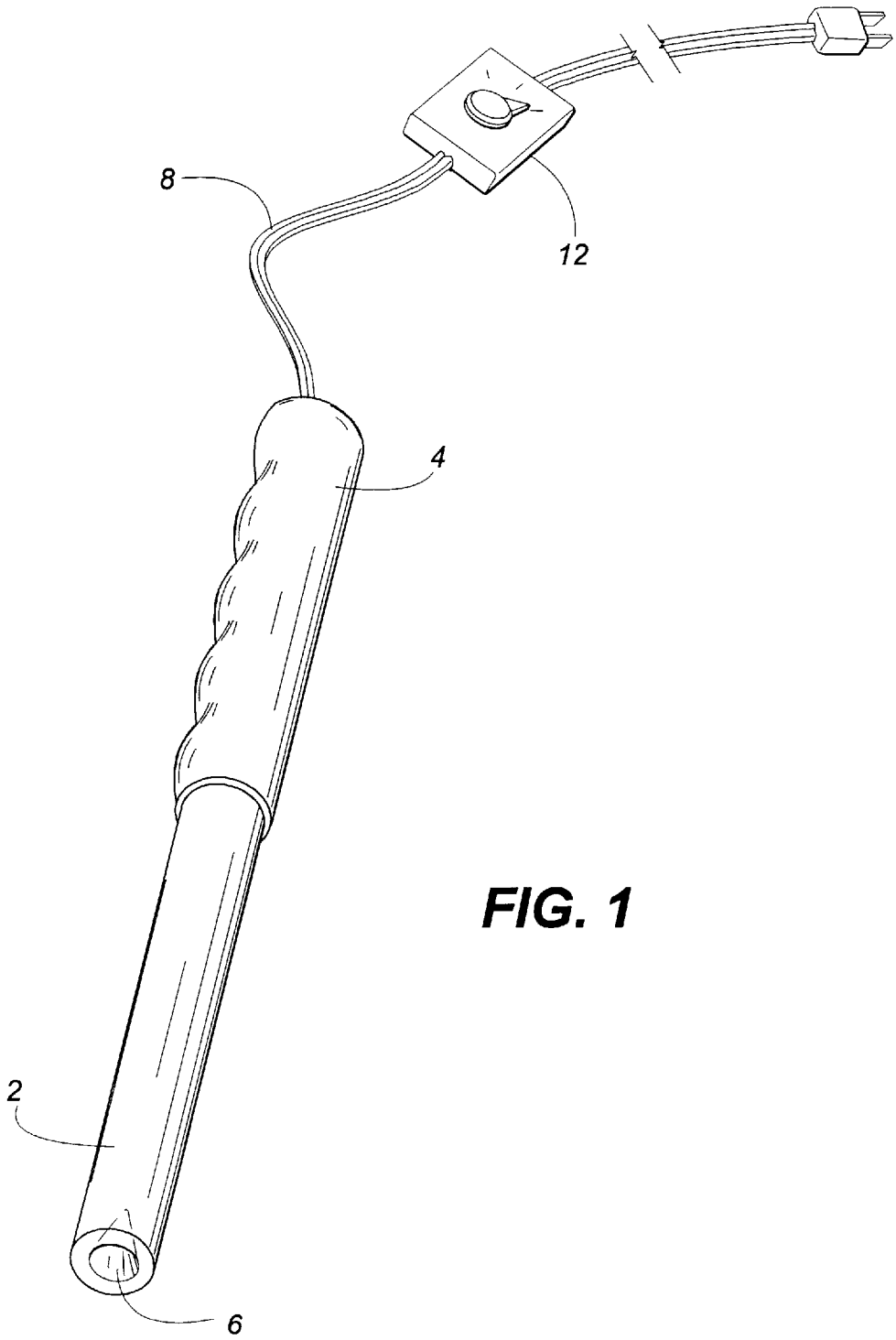
FIG. 1 is a perspective view of a first embodiment of the device.

Referring now to the drawing figures, FIG. 1 shows the hair braid pointing device. In the preferred embodiment, the hair braid pointing device has an elongated shape. A heating element 2 is present on one end of the device, and a handle 4 is present on the opposite end of the device.

A conically shaped void is present within the heating element. As shown in FIG. 1, conically shaped void 6 is present on one end of the heating element.

Means is provided for heating the heating element. The preferred means for heating the heating element provides heat to the heating element by means of electrical resistance. Accordingly, the resistance means will typically be located inside the heating element and in contact with the heating element. The heating element is formed of a material having good heat conductivity properties, such as a metal. The metal could be aluminum, copper, or ferrous material such as stainless steel. Other metals could be used, although relatively inexpensive materials having good conductivity and corrosion resistance are preferred.

Means may be provided for regulating the heat of the heating element. A variable rheostat could be used to regulate the temperature of the device when heated by electrical resistance means.

Typically, and as shown in the embodiment of FIG. 1, the handle is in close proximity to the heating element, but on the opposite end of the longitudinal device from the heating element. The handle should be a material having good insulative properties so that the user does not burn his or her hand as the device is held by the user. The handle may cover either part of the heating element, as long as the insulative properties are sufficient to prevent the user from burning hair or hand. A guard may be provided at or near the end of the handle which is closest to the heating element to further protect the user's hand from the heating element.

Excepting the area within the conical void, it is not necessary for the heating element to provide heat, and accordingly, the heating element may be shorter than the heating element shown in FIG. 1. Alternatively, the heating element may be covered with insulative material, while exposing only the conical void.

Other means could be provided for heating the heating element as shown in FIG. 1. If the electrical cord 8 is eliminated, the heating element could be heated by external means, such as by inserting the heating element in boiling water, or heating it over open flame. In this case, a substantial length of the heating element should be exposed for the purpose of applying heat.

Figure 2:
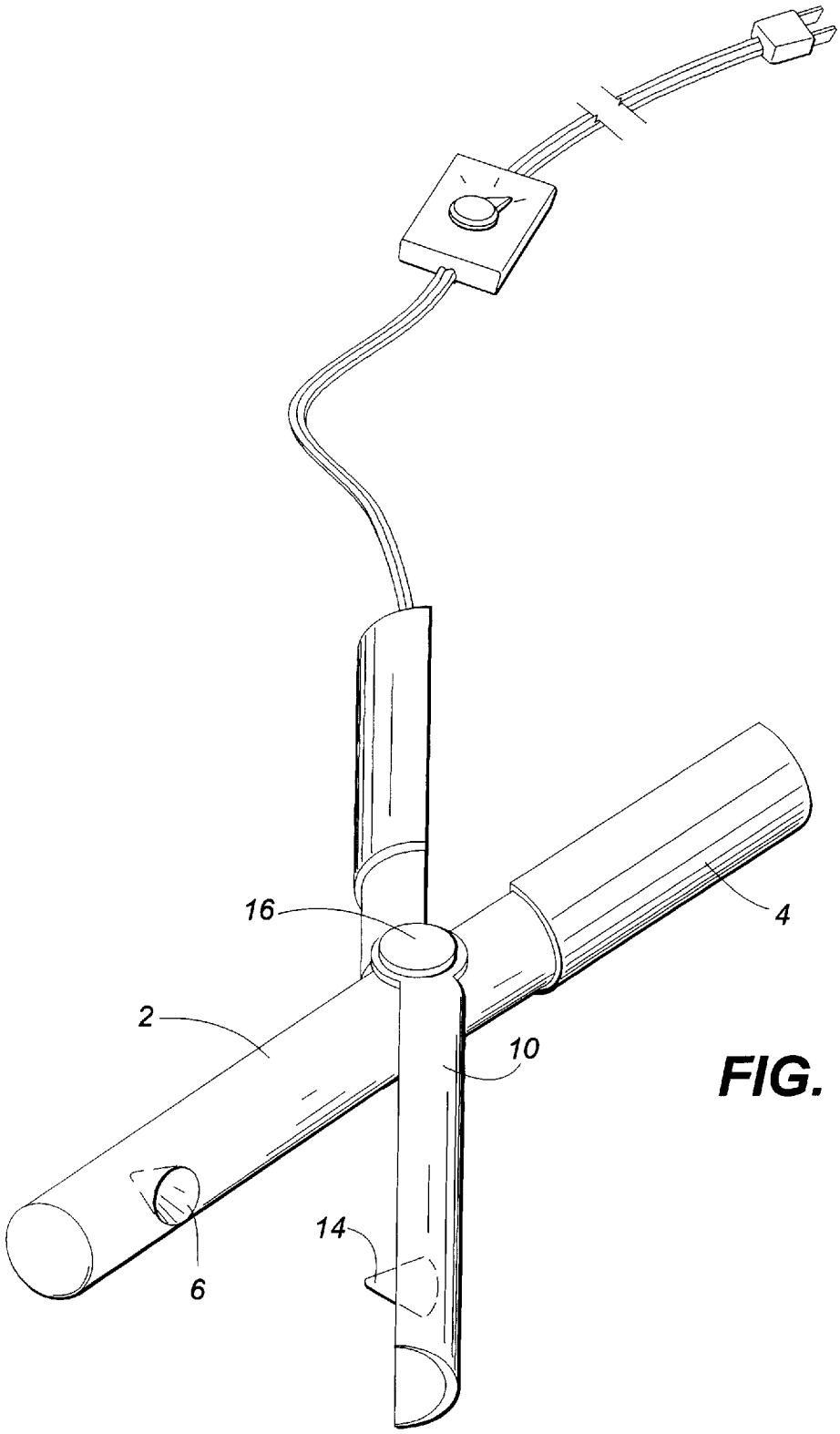
FIG. 2 is a perspective view of a second embodiment of the device.
Figure 3:
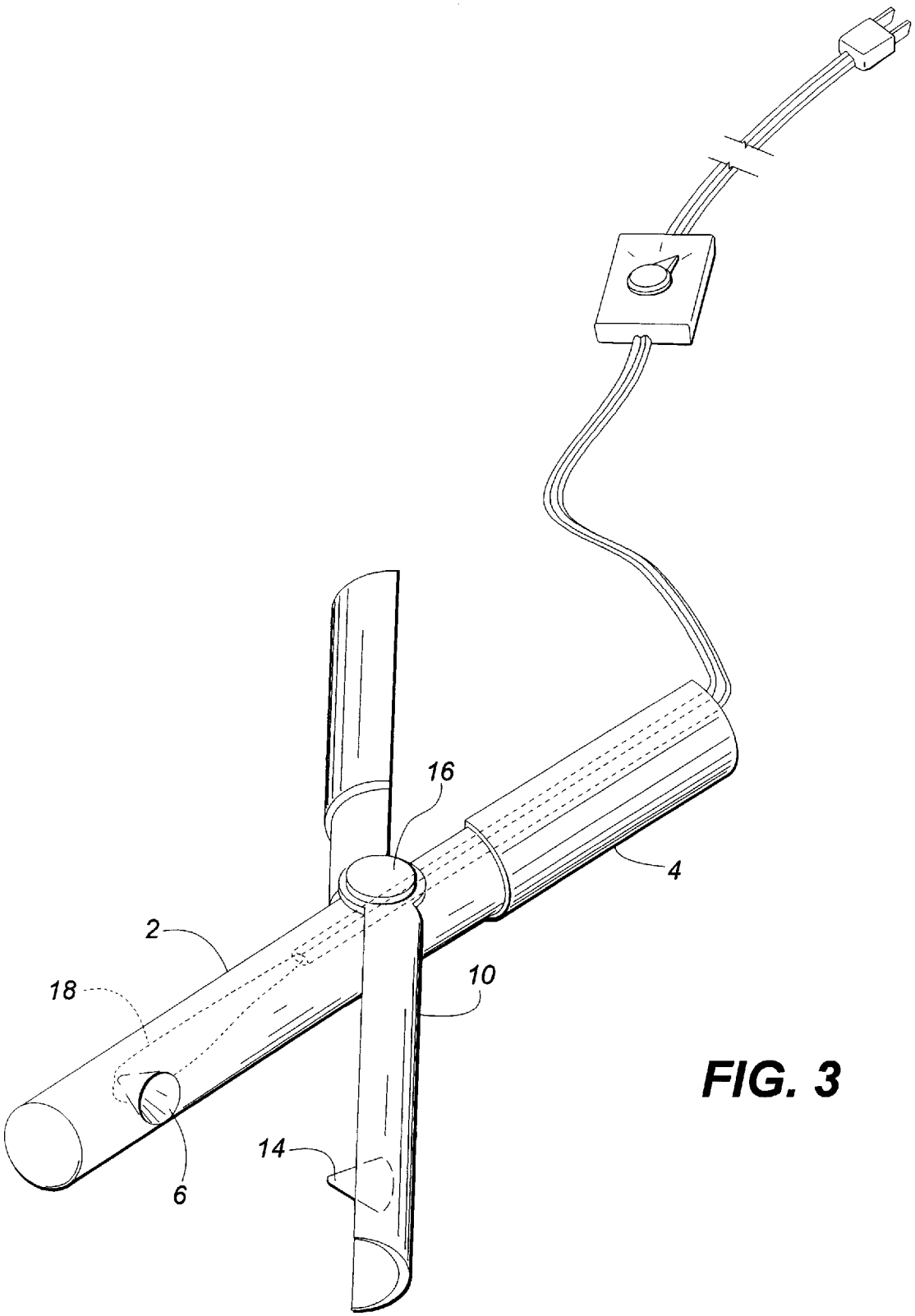
FIG. 3 is another view of the second embodiment of the device, showing an electrical resistor 18, as a phantom, in the element.

A second embodiment of the device is shown in FIG. 2. This embodiment of the device is similar to the device shown in FIG. 1, excepting that the void is positioned along the length of the device. Clamp 10 is provided for holding the hair against the heating element and within the conical void. If preferred, clamp 10 may have a conical shaped protrusion 14 formed thereon which engages the conical void 6. Clamp 10 is pivotally or hingably connected to a longitudinal member 2, or the heating element. The pivotal connection may be by means of a pin, hinge or pivot 16. Clamping means may be provided in a similar manner at the end of the longitudinal member 2, when the conical void 6 is formed in the end, as shown in FIG. 1, to hold hair within the conical void.

In use, heat is provided to the heating element. In the preferred embodiment, the power cord is connected to a wall outlet by means of the plug, and the selector switch 12 is set to the desired heating level. The device is allowed to heat by resistance heating.

Once the device has reached sufficient temperature, the device is held in one hand, while a hair braid is held in the opposite hand. The end of the hair braid is inserted within the conical void and held until the point is formed in the hair by the application of heat. Successive hair braids may be inserted as desired When the embodiment shown in FIG. 2 is used, the hair may be inserted into the void, and held within the void by the clamping means.

What is claimed is:

1. A device for forming points on hair braids, comprising:

a. an elongated for clarity heating element having a conically shaped void formed in elongated heating element, said conically shaped void opening to an exterior surface of said heating element; and b. means for providing heat to an area of said elongated heating element which is adjacent to said conically shaped void.

2. A device for forming points on hair braids as described in claim 1, wherein said heating element has an insulating handle on one end thereof, and wherein said conically shaped void is near an opposite end of said heating element.

3. A device for forming points on hair braids as described in claim 1, wherein said means for providing heat to said conically shaped void is an electrical resistor.

4. A device for forming points on hair braids, comprising a longitudinal member, wherein said longitudinal member has a handle on one end thereof, and said longitudinal member has a heating element on an end thereof which is opposite said heating element, and wherein said heating element has a conically shaped void formed in said heating element, said conically shaped void opening to an exterior surface of said heating element.

5. A device for forming points on hair braids as described in claim 4, further comprising an electrical resistor within said longitudinal member and adjacent to said conically shaped void.

6. A device for forming points on hair braids as described in claim 1, wherein said device further comprises a clamp which is pivotally connected to said heating element and which engages said heating element.

7. A device for forming points on hair braids as described in claim 6, wherein said clamp comprises a protrusion which engages said conically shaped void as said clamp engages said heating element.

8. A device for forming points on hair braids as described in claim 2, wherein said device further comprises a clamp which is pivotally connected to said heating element and which engages said heating element.

9. A device for forming points on hair braids as described in claim 8, wherein said clamp comprises a protrusion which engages said conically shaped void as said clamp engages said heating element.

10. A device for forming points on hair braids as described in claim 4, wherein said device further comprises a clamp which is pivotally connected to said longitudinal member and which engages said longitudinal member.

11. A device for forming points on hair braids as described in claim 10, wherein said clamp comprises a protrusion which engages said conically shaped void as said clamp engages said longitudinal member.

* * * * *